US005193318A

United States Patent [19]

D'Antonio et al.

[11] Patent Number: 5,193,318

[45] Date of Patent: * Mar. 16, 1993

[54] ACOUSTICAL DIFFUSING AND ABSORBING CINDER BLOCKS

[75] Inventors: Peter D'Antonio, Largo, Md.; John H. Konnert, Reston, Va.

[73] Assignee: RPG Diffusor Systems, Inc., Upper Marlboro, Md.

[ * ] Notice: The portion of the term of this patent subsequent to Oct. 23, 2007 has been disclaimed.

[21] Appl. No.: 780,955

[22] Filed: Oct. 23, 1991

[51] Int. Cl.[5] ..... E04B 1/82

[52] U.S. Cl. ..... 52/144; 52/606; 181/285

[58] Field of Search ..... 52/144, 606; 181/286, 181/285, 198, 290, 224

[56] References Cited

U.S. PATENT DOCUMENTS

| | | | |
|---|---|---|---|
| 4,821,838 | 4/1989 | Chen | 181/191 |
| 4,964,486 | 10/1990 | D'Antonio | 181/286 |
| 5,027,920 | 7/1991 | D'Antonio | 181/286 |

*Primary Examiner*—David A. Scherbel
*Assistant Examiner*—Beth A. Aubrey
*Attorney, Agent, or Firm*—H. Jay Spiegel

[57] ABSTRACT

Disclosed are embodiments of structural acoustical cinder blocks including blocks which are intended to be assembled together through the use of mortar to provide a diffusor of desired shape and configuration. Each diffusor includes a plurality of wells, the depths of which are determined through the use of number theory sequences, such as, for example, the quadratic-residue sequence developed by Karl Frederick Gauss. The surface irregularities formed in the blocks are unique in that they provide a flat power spectrum and constant scattered energy in the diffraction directions. Each of the blocks also includes a low frequency sound absorbing chamber. As the blocks are installed, a structural stacked bond is formed on both the diffusor face and the rear structural face. If desired, a single block may be made which includes an entire sequence of wells and dividers.

17 Claims, 3 Drawing Sheets

ACOUSTICAL DIFFUSING AND ABSORBING CINDER BLOCKS

BACKGROUND OF THE INVENTION

The present invention relates to acoustical diffusing and absorbing cinder blocks. Acoustic diffusors are known per se. In this regard, reference is made to the following patents issued to co-applicants D'Antonio and Konnert: U.S. Pat. Nos. D291,601 issued Aug. 25, 1987, 4,964,486 issued Oct. 23, 1990 and 5,027,920 issued Jul. 2, 1991. Furthermore, coapplicants D'Antonio and Konnert are also applicants in U.S. Pat. No. 4,821,839 issued Apr. 18, 1989 which discloses a sound absorbing diffusor using the quadratic-residue number theory as well as sound absorbing materials to absorb sound in a controlled manner. Applicants D'Antonio and Konnert are also patentees of U.S. Pat. No. D306,764 which is directed to an acoustical diffusor having a plurality of wells of approximately square cross-section.

While U.S. Pat. Nos. 4,964,486 and 5,027,920 describe acoustical diffusors made of cinder blocks, these references fail to include various aspects of the present invention including the use of chambers to receive mortar and reinforcing bars and the provision of low frequency sound absorbing chambers.

Further, Applicants are aware of a product sold under the Trademark "SOUNDBLOX" which resembles cinder blocks and which includes slots therein not made in accordance with the number theory sequences. While "SOUNDBLOX" are provided for sound absorption purposes, they have no disclosed or intended sound diffusing characteristics. They include narrow openings allowing entry into internal chambers designed to absorb sound and control reverberation. While such structures, generally speaking, are incorporated in the present invention, the present invention contemplates devices which also include important diffusing characteristics.

SUMMARY OF THE INVENTION

The present invention relates to acoustical diffusing and absorbing cinder blocks. The present invention includes the following interrelated objects, aspects and features:

(A) The present invention includes embodiments each of which consists of a plurality of cinder blocks having structure thereon designed to allow the cinder blocks to be combined together to create acoustical diffusors.

(B) In each of the embodiments of the present invention, each block has an internal chamber accessed through a slot at some location on the face of the diffusor portion thereof, which chamber comprises a low frequency sound absorber.

(C) In a further aspect, each of the embodiments of the present invention includes one or more further chambers either entirely formed within a single block or formed when combined with an adjacent block, which further chambers are designed to receive mortar and reinforcing bars.

(D) In a first embodiment of the present invention, each "further chamber" comprises a single chamber formed in each block and designed to receive mortar allowing interconnection with vertically stacked blocks, with each "further chamber" also receiving a plurality of reinforcing bars. In a second embodiment of the present invention, each "further chamber" consists of two chambers formed in each block and connected together by side passageways, with these "further chambers" being designed to receive mortar and reinforcing bars to facilitate vertical stacking of blocks as well as horizontally disposed reinforcing bars which may extend through the passageways described above and through adjacent blocks in the same manner. In a third embodiment of the present invention, each "further chamber" is formed by a combination of structures found in two adjacent blocks. In this embodiment, the "further chambers" facilitate both vertical stacking of blocks and fastening of laterally adjacent blocks together. In the first and second embodiments described above, lateral fastening is accomplished by application of mortar on adjacent abutting surfaces.

(E) In each embodiment of the present invention, some wells are formed by a combination of walls and shoulders located on adjacent blocks.

(F) In each embodiment of the present invention illustrated in the drawing figures, an entire sequence of wells is created by the combination of three blocks. Of course, if desired, each set of three blocks may, instead, be made as a single block including an entire sequence of wells thereon.

(G) The diffusors made in accordance with the teachings of the present invention include a plurality of wells, the respective depths of which are determined through operation of the quadratic-residue number theory sequence. The wells are of substantially equal widths as compared to one another and create a phase grating. The quadratic-residue number theory sequence is based upon a formula, $n^2$ (modulo N) where N is a prime number, developed by Karl Frederick Gauss. The explanation set forth in U.S. Pat. No. 4,964,486 is hereby incorporated by reference herein.

As such, it is a first object of the present invention to provide acoustical diffusing and absorbing cinder blocks.

It is a further object of the present invention to provide diffusing cinder blocks having the further provision of internal chambers providing low frequency sound absorption.

It is a yet further object of the present invention to provide such blocks with structural features best facilitating installation while maintaining structural integrity.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
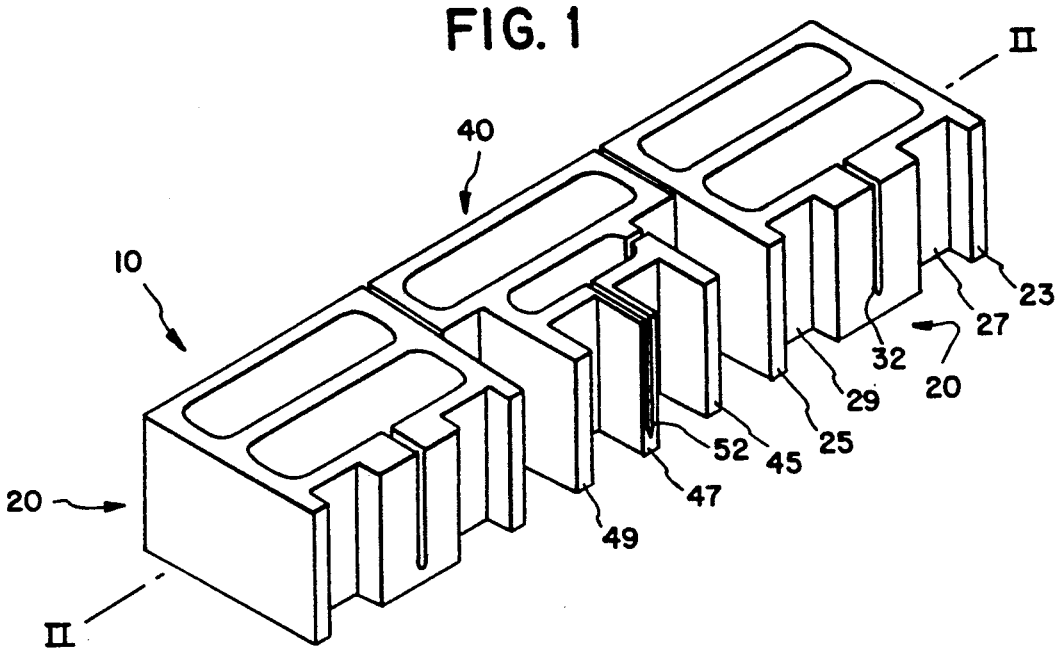
FIG. 1 shows an isometric view of a first embodiment of the present invention.
Figure 2:
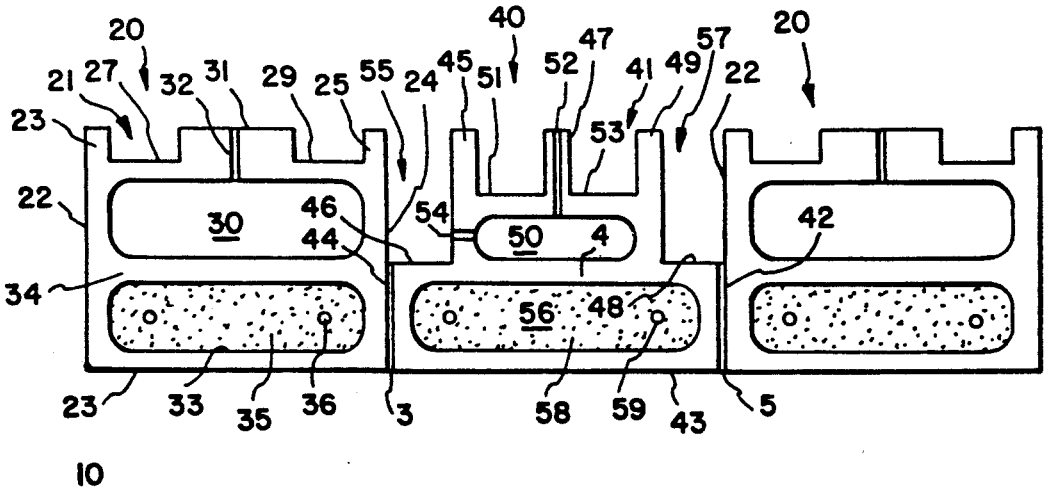
FIG. 2 shows a cross-sectional view along the line II—II of FIG. 1.

With reference, first, to FIGS. 1 and 2, a first embodiment of the present invention is generally designated by the reference numeral 10 and is seen to include blocks 20, 40 and 20. Of course, the blocks 20 are identical to one another and, as such, only one of these blocks will be described in great detail.

Each of the blocks 20 includes a front surface 21 and a rear surface 19. The front surface 21 includes side dividers 23, 25, wells 27, 29 of depth "1" and a well 31 of depth "0".

As shown in FIGS. 1 and 2, an internal chamber 30 is provided within the block 20 and is accessed to atmosphere via a slot 32 which opens in the well 31. The chamber 30 consists of a low frequency sound absorbing chamber.

The blocks 20 each also include a further chamber 33 rearwardly spaced from the chamber 30 by a dividing wall 34. As shown in FIG. 2, in particular, the chamber 33 may be filled with mortar 35 to facilitate vertical stacking of blocks 20 and may also contain reinforcement bars (rebar) designated by the reference numeral 36 and designed to reinforce the mortar 35 to enhance the bond thereof.

The block 20 has generally flat side walls 22 and 24.

The block 40 includes a front surface 41 and a rear surface 43 along with side walls 42 and 44 which extend only partially from the rear surface 43 toward the front surface 41, terminating at shoulders 46 and 48. The front surface 41 includes dividers 45, 47 and 49 as well as wells 51 and 53 of depth "2". As shown in FIG. 2, in particular, a well 55 of depth "4" is formed by the combination of the side wall 24 of the block 20, the shoulder 46 and the divider 45 of the block 40. Similarly, a further well 57 of depth "4" is formed by the side wall 22 of the block 20, the shoulder 48 and the divider 49 of the block 40.

As best shown in FIG. 2, the block 40 has an internal chamber 50 which is accessed to atmosphere in one of two ways. Such access is provided by either the slot 52 shown formed in the divider 47 or the slot 54 shown opening in the well 57. It should be understood by those skilled in the art that only one of the access slots 52, 54 will be employed with the decision being discretionary. It is preferred that the slot 54 be employed since the slot 52 may limit the structural integrity of the divider 47.

With further reference to FIG. 2, it is seen that a further chamber 56 is provided which is designed to contain mortar 58 and reinforcing bars 59 for the same reasons set forth with respect to the corresponding structure in the blocks 20.

As seen in FIG. 2, in particular, the abutting walls of the blocks 20, 40 and 20 are fastened together through the use of mortar 3, 5.

Figure 3:
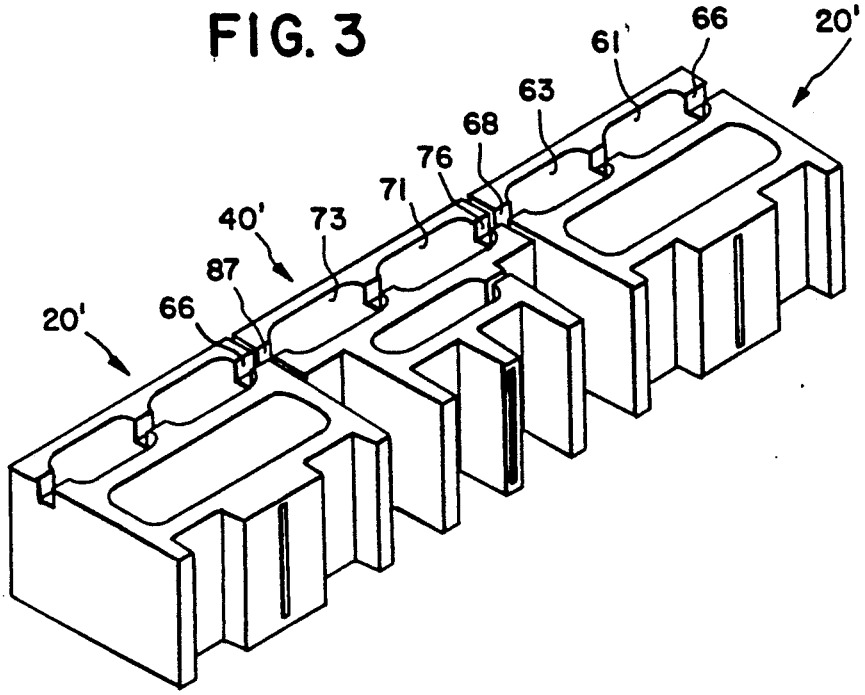
FIG. 3 shows an isometric view of a second embodiment of the present invention.
Figure 4:
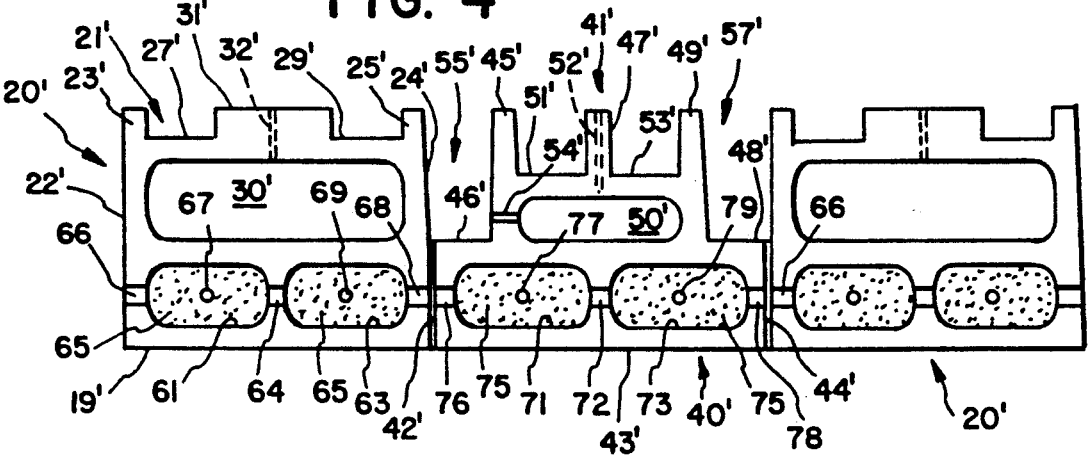
FIG. 4 shows a cross-sectional view along the line IV—IV of FIG. 3.

With reference to FIGS. 3 and 4, a second embodiment of the present invention will be described. In this further embodiment, like elements will be designated using like primed reference numerals.

With reference to FIGS. 3 and 4, a second embodiment of the present invention is generally designated by the reference numeral 10' and is seen to include blocks 20', 40' and 20'. Of course, the blocks 20' are identical to one another and, as such, only one of these blocks will be described in great detail.

Each of the blocks 20' includes a front surface 21' and a rear surface 19'. The front surface 21, includes side dividers 23', 25', wells 27', 29' of depth "1" and a well 31' of depth "0".

As shown in FIGS. 3 and 4, an internal chamber 30' is provided within the block 20' and is accessed to atmosphere via a slot 32' which opens in the well 31'. The chamber 30' consists of a low frequency sound absorbing chamber.

The block 20' has generally flat side walls 22' and 24'.

The block 40' includes a front surface 41' and a rear surface 43' along with side walls 42' and 44' which extend only partially from the rear surface 43' toward the front surface 41', terminating at shoulders 46' and 48'. The front surface 41' includes dividers 45', 47' and 49' as well as wells 51' and 53'. As shown in FIG. 4, in particular, a well 55' is formed by the combination of the side wall 24' of the block 20', the shoulder 46' and the divider 45' of the block 40'. Similarly, a further well 57' is formed by the side wall 22' of the block 20', the shoulder 48' and the divider 49' of the block 40'.

As best shown in FIG. 4, the block 40' has an internal chamber 50' which is accessed to atmosphere in one of two ways. Such access is provided by either the slot 52' shown formed in the divider 47' or the slot 54' shown opening in the well 57'. It should be understood by those skilled in the art that only one of the access slots 52', 54' will be employed with the decision being discretionary. It is preferred that the slot 54' be employed since the slot 52' may limit the structural integrity of the divider 47'.

As seen in FIGS. 3 and 4, instead of a single further chamber as included in the blocks 20 and 40, the blocks 20' and 40' each have a plurality of further chambers. Thus, the block 20' has a first further sub-chamber 61 and a second further subchamber 63 each of which has contained therein mortar 65 and reinforcing bars 67 and 69. The sub-chambers 61 and 63 are interconnected by virtue of a lateral passageway 64 and further lateral passageways 66 and 68 are provided to connect with the further sub-chambers of adjacent blocks.

Similarly, the block 40' has a first further sub-chamber 71 and a second further sub-chamber 73, which further sub chambers are interconnected by virtue of the lateral passageway 72. As shown in FIG. 4, in particular, the lateral passageway 76 interconnects with the lateral passageway 68 of the block 20' while the lateral passageway 78 interconnects with the lateral passageway 66 of the other block 20'. As shown in particular in FIG. 4, the further sub-chamber 71 contains mortar 75 and a reinforcing bar 77 while the further sub-chamber 73 contains mortar 75 and a reinforcing bar 79.

Figure 5:
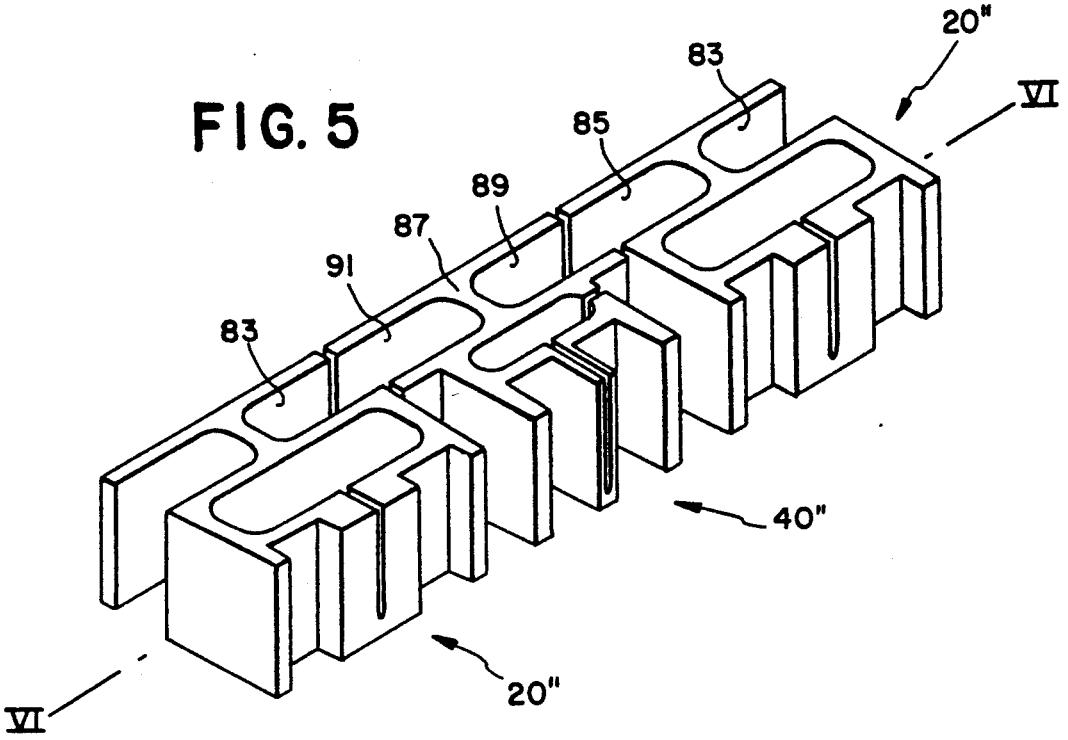
FIG. 5 shows an isometric view of a third embodiment of the present invention.
Figure 6:
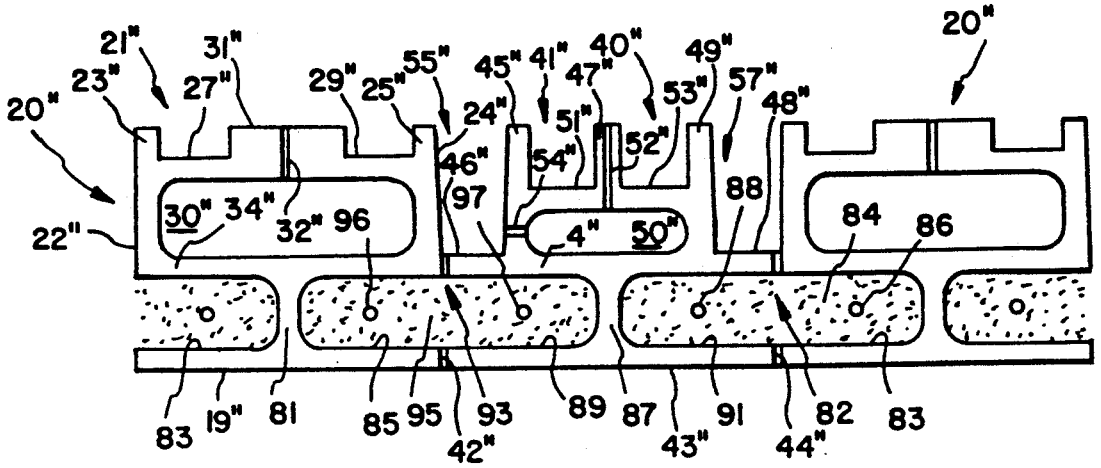
FIG. 6 shows a cross-sectional view along the line VI—VI of FIG. 5.

With reference, now, to FIGS. 5 and 6, a third embodiment of the present invention will now be described in detail, where like elements as compared to the embodiments of FIGS. 1 and 2 and FIGS. 3 and 4 will be described using like double primed reference numerals.

With reference to FIGS. 5 and 6, a third embodiment of the present invention is generally designated by the reference numeral 10" and is seen to include blocks 20", 40" and 20". Of course, the blocks 20" are identical to one another and, as such, only one of these blocks will be described in great detail.

Each of the blocks 20" includes a front surface 21" and a rear surface 19". The front surface 21" includes side dividers 23", 25", wells 27", 29" of depth "1" and a well 31" of depth "0".

As shown in FIGS. 5 and 6, an internal chamber 30" is provided within the block 20" and is accessed to atmosphere via a slot 32" which opens in the well 31". The chamber 30" consists of a low frequency sound absorbing chamber.

The block 20" has generally flat side walls 22" and 24".

The block 40" includes a front surface 41" and a rear surface 43" along with side walls 42" and 44" which extend only partially from the rear surface 43" toward the front surface 41", terminating at shoulders 46" and 48". The front surface 41"includes dividers 45", 47" and 49" as well as wells 51" and 53". As shown in FIG. 6, in particular, a well 55" is formed by the combination of the side wall 24" of the block 20", the shoulder 46" and the divider 45" of the block 40". Similarly, a further well 57" is formed by the side wall 22" of the block 20", the shoulder 48" and the divider 49" of the block 40".

As best shown in FIG. 6, the block 40" has an internal chamber 50" which is accessed to atmosphere in one of two ways. Such access is provided by either the slot 52" shown formed in the divider 47" or the slot 54" shown opening in the well 57". It should be understood by those skilled in the art that only one of the access slots 52", 54" will be employed with the decision being discretionary. It is preferred that the slot 54" be employed since the slot 52" may limit the structural integrity of the divider 47".

With particular reference to FIG. 6, it is seen that the block 20" has, connected to the dividing wall 34", a vertical divider 81 dividing the rear portion of the block 20" into partial further chambers 83 and 85. These partial further chambers are designed to combine together with further partial chambers of adjacent blocks to together form a single further chamber. In this regard, with reference to FIG. 6, it is seen that the block 40" has, adjacent the dividing wall 4" thereof, a vertical divider wall 87 dividing the rearward portion of the block 40" into further partial sub-chambers 89 and 91. As shown in FIG. 6, the partial sub chambers 85 and 89 of adjacent blocks 20" and 40"combine together to form a further chamber 93 containing mortar 95 and reinforcing bars 96 and 97. In a further aspect, the further partial sub-chamber 91 of the block 40" combines together with the further partial sub-chamber 83 of the other block 20" to form a further chamber 82 containing mortar 84 and reinforcing bars 86 and 88. The mortar 95, 84 performs two functions, firstly, interlocking laterally adjacent blocks 20" and 40" and, secondly, allowing vertical stacking of a plurality of blocks 20" or 40" as desired.

As discussed above, if desired, in each of the embodiments of the present invention described above, the three blocks shown may be combined together into a single block which includes all of the features and aspects thereof including, where necessary, partial further sub-chambers designed to be used to allow interlocking of adjacent blocks. As should also be understood, each of the embodiments of the present invention, where necessary, may include mortar such as the mortar 3, 5 best illustrated in FIG. 2. This aspect particularly applies to the embodiment illustrated in FIGS. 3 and 4, since the mortar 95, 84 of the embodiment of FIGS. 5 and 6 eliminates the need for mortar in other abutting edges of adjacent blocks 20" and 40".

A preferred mode of installation of the present invention would include the installation of a footing with vertical rebar reinforcement bars in place. The use of cavities such as the cavities designated by the reference numerals 33, 56, 61, 63, 71, 73, 93, 82 allows the blocks to be lowered over the bars and to be "mortared" in place. Horizontal rebar reinforcement bars may be horizontally inserted as each course has been installed, particularly in the embodiment illustrated in FIGS. 3 and 4.

Of course, while the sequence of wells and dividers disclosed is on which is formed through operation of the quadratic-residue number theory sequence, other sequences may be created using different sequence formulae including primitive roots, Legendre polynomials, Zech logarithms or any sequence for which the Fourier transform of the exponentiated sequence depths is a constant or nearly so.

As such, as invention has been disclosed in terms of preferred embodiments thereof which fulfill each and every one of the objects of the present invention as set forth hereinabove and provide a new and useful diffusing cinder block system of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

We claim:

1. A cinder block comprising:

a) a block having a first face having a plurality of wells, said wells being of particular depths with respect to one another which are determined by use of a quadratic-residue number theory sequence, wherein each consecutive well is given a number from 0 to n, where n equals one less than a total number of wells, and wherein a depth of any particular well is determined by squaring said number for said particular well and dividing said squared number by a chosen modulus number resulting in a remainder, the remainder after said dividing being multiplied by a chosen constant to arrive at said depth of said particular well;

b) said block having a second face on an opposite side of said block from said first face, said second face enclosing at least a portion of a mortar chamber facilitating attachment of said block to an adjacent structure.

2. The invention of claim 1, wherein said plurality of wells comprises a portion of an entire sequence of wells.

3. The invention of claim 1, wherein said plurality of wells comprises an entire sequence of wells.

4. The invention of claim 1, wherein said block includes an internal low frequency sound absorbing chamber accessed via an access opening exposed to ambient atmosphere.

5. The invention of claim 4, wherein said access opening opens within one of said wells.

6. The invention of claim 5, wherein said one of said wells is of zero depth.

7. The invention of claim 4, wherein said access opening comprises a terminus of an elongated slot.

8. The invention of claim 7, wherein said slot is elongated in a direction parallel to a direction of elongation of a well of greater than zero depth.

9. The invention of claim 1, wherein said adjacent structure comprises an adjacent block having a third face having a further plurality of wells therein being of particular depths with respect to one another which are determined by use of said quadratic-residue number theory sequence and a fourth face enclosing at least a portion of a further mortar chamber therein.

10. The invention of claim 9, wherein at least one well is formed by spaced walls on said block and adjacent block.

11. The invention of claim 1, wherein said mortar chamber is generally rectangular cubic in shape.

12. The invention of claim 1, wherein said at least a portion of a mortar chamber comprises a complete mortar chamber.

13. The invention of claim 9, wherein said at least a portion of a mortar chamber combines with said at least a portion of a further mortar chamber to comprise, together, a single mortar chamber.

14. The invention of claim 1, wherein said at least a portion of a mortar chamber comprises two mortar sub-chambers connected by a lateral connecting passage.

15. The invention of claim 12, further including mortar and a reinforcing bar in said complete mortar chamber.

16. The invention of claim 13, further including mortar and a reinforcing bar in said single mortar chamber.

17. The invention of claim 14, further including mortar and a reinforcing bar in each of said sub-chambers.

* * * * *